US007758378B2

(12) United States Patent
Yoshida et al.

(10) Patent No.: US 7,758,378 B2
(45) Date of Patent: Jul. 20, 2010

(54) CONNECTOR AND CIRCUIT-BOARD-MOUNTING CASE HAVING CONNECTOR ASSEMBLY

(75) Inventors: Shingo Yoshida, Ichinomiya (JP); Masaru Kondo, Kasugai (JP); Takaya Hirai, Iwakura (JP)

(73) Assignee: NGK Spark Plug Co., Ltd., Nagoya, Aichi (JP)

( * ) Notice: Subject to any disclaimer, the term of this patent is extended or adjusted under 35 U.S.C. 154(b) by 0 days.

(21) Appl. No.: 12/338,162

(22) Filed: Dec. 18, 2008

(65) Prior Publication Data

US 2009/0156064 A1 Jun. 18, 2009

(30) Foreign Application Priority Data

Dec. 18, 2007 (JP) ..... 2007-325453

(51) Int. Cl.
*H01R 13/40* (2006.01)

(52) U.S. Cl. ..... 439/587

(58) Field of Classification Search ..... 439/587, 439/279, 148, 271–275, 586
See application file for complete search history.

(56) References Cited

U.S. PATENT DOCUMENTS

| | | | | |
|---|---|---|---|---|
| 5,199,901 | A | 4/1993 | Balser et al. | |
| 5,931,699 | A * | 8/1999 | Saito | 439/587 |
| 6,039,603 | A * | 3/2000 | Wakata et al. | 439/587 |
| 6,247,965 | B1 * | 6/2001 | Cummings et al. | 439/587 |
| 6,390,848 | B1 | 5/2002 | Murakami et al. | |
| 6,582,242 | B2 * | 6/2003 | Murakami et al. | 439/271 |
| 6,733,318 | B2 * | 5/2004 | Myer et al. | 439/248 |
| 7,175,480 | B2 | 2/2007 | Yamashita | |
| 7,371,092 | B2 * | 5/2008 | Okumura et al. | 439/205 |
| 2003/0176094 | A1 | 9/2003 | Myer et al. | |
| 2003/0207615 | A1 | 11/2003 | Oota et al. | |

FOREIGN PATENT DOCUMENTS

| | | |
|---|---|---|
| FR | 2603745 | 3/1988 |
| JP | 10-247541 | 9/1998 |

* cited by examiner

*Primary Examiner*—Chandrika Prasad
(74) *Attorney, Agent, or Firm*—Stites & Harbison PLLC; Ross F. Hunt, Jr.; Jeffrey A. Haeberlin

(57) ABSTRACT

A connector assembly includes a metal terminal, a lead wire, a connector housing and a sealing member. The metal terminal defines a longitudinal direction. The metal terminal comprises: a lead-wire connection portion located on a front end side; a counterpart connection portion located on a rear end side; and a press-fit portion located between the lead-wire connection portion and the counterpart connection portion. The press-fit portion comprises a curved portion which curves around an imaginary axis extending in the longitudinal direction. The lead wire comprises an end portion connected to the lead-wire connection portion of the metal terminal and comprising an outer circumferential surface. The connector housing comprises a press-fit hole having a wall surface. The press-fit portion of the metal terminal is press-fit into the press-fit hole. The sealing member provides a seal between the outer circumferential surface of the lead wire and the wall surface of the press-fit hole.

7 Claims, 15 Drawing Sheets

CONNECTOR AND CIRCUIT-BOARD-MOUNTING CASE HAVING CONNECTOR ASSEMBLY

BACKGROUND OF THE INVENTION

1. Field of the Invention

The present invention relates to a connector configured such that metal terminals (which may hereinafter be referred to merely as "terminals") connected to end portions of lead wires are assembled to a connector housing made of, for example, resin, as well as to a circuit-board-mounting case, or casing, to which the connector is attached.

2. Description of Related Art

Japanese Patent Application Laid-Open (kokai) No. H10-247541, and Japanese Patent Application Laid-Open (kokai) No. 2004-362814 disclose, for example: a terminal being press-fit into a press-fit hole of a connector housing made of resin to thereby be assembled to the connector housing; and the terminal being in a locked condition against detachment.

Each of such terminals is formed from a flat sheet of metal, such as sheet metal, and comprises a predetermined, elongated narrow flat sheet. The terminal is longitudinally press-fit into the press-fit hole of the connector housing, thereby being assembled to the connector housing. When such a metal terminal is press-fit into the press-fit hole, a stopper portion of the metal terminal butts against a stopper portion, or butting face, of the press-fit hole, thereby positioning the metal terminal with respect to a press-fit direction (i.e., a direction in which press-fitting progresses). In order to provide detachment prevention means for preventing detachment of the metal terminal in a direction opposite the press-fit direction (i.e., the direction toward the inlet of the press-fit hole), side edge portions of the metal terminal have respective projections, or biting portions, which bite into the wall surface of the press-fit hole following the press-fitting of the metal terminal into the press-fit hole. The projections biting into the wall surface of the press-fit hole prevents detachment of the metal terminal from the connector housing.

In such a connector, a metal terminal may be assembled to a connector housing in the following manner: 1) the metal terminal is connected to an end portion of a lead wire, or a conductor, by crimping or a similar process; and 2) the metal terminal is press-fit into a press-fit hole of a connector housing from a lead-wire connection portion located on the front end side with respect to a press-fit direction, by pushing a counterpart connection portion located on the rear end side thereof with respect to the press-fit direction, to thereby be assembled to the connector housing. More specifically, the lead wire is inserted through the press-fit hole of the connector housing from the exterior side of the connector housing. Then the metal terminal is connected to an end portion of the lead wire. Then the lead wire is pulled in a direction opposite the direction in which the lead wire was inserted (i.e., the lead wire is pulled toward the exterior of the connector housing), thereby press-fitting, or pressing, the metal terminal into the press-fit hole and thus assembling the metal terminal to the connector housing.

When the above-mentioned metal terminal is press-fit into the press-fit hole of the connector housing, even when the metal terminal undergoes press-fitting in such a manner as to be pressed straight along the press-fitting direction, the metal terminal is likely to be deformed. More specifically, the metal terminal is likely to be flexed, folded or buckled in its plane direction due to: a) the cross-sectional shape of the metal terminal; b) the press-fit resistance caused by friction between the metal terminal and the wall surface of the press-fit hole; or c) a deviated load. Such deformation is likely to arise particularly when, in the course of press-fitting, the projections of the side edge portions of the metal terminal encounter high resistance with the wall surface of the press-fit hole.

In the above-described connector, a watertight seal can be provided for the interior of the press-fit hole. In one method, in molding the connector housing, such as from resin, the metal terminal can be placed in a mold as an insert and insert-molded to thereby be integrated with the connector housing. However, this method is accompanied by complication of the mold and a molding process, resulting in an increase in cost. Therefore, the following alternate method is conventionally employed: 1) the connector housing is manufactured in a separate process; 2) a sealing elastic member, or seal packing, formed of an elastic material, such as rubber, is externally attached to an end portion of a lead wire located toward the metal terminal, or to a portion of the lead wire located toward the end portion; and 3) the sealing elastic member, together with the metal terminal, is subjected to press-fitting work. By this alternate method, a seal is established between the outer circumferential surface of the lead wire and the wall surface of the press-fit hole.

In the case where the connector having such a watertight seal employs the aforementioned alternate method of assembling the metal terminal to the connector housing, the press-fit resistance of the sealing elastic member is added to the press-fit resistance of the metal terminal. Thus, the overall press-fit resistance increases. When the metal terminal, together with the sealing elastic member, is press-fit into the press-fit hole by pressing its counterpart connection portion located on the rear end side, the force to be applied for press-fitting (i.e., the press-in force) must be further increased. Therefore, the aforementioned deformation, such as flexure, folding or buckling of the metal terminal is more likely to occur.

Additionally, even when the metal terminal can be press-fit without deformation, after press-fitting, an external force applied in a plane direction to a projecting end of the metal terminal is likely to cause the metal terminal to be readily flexed since metal terminal is low in section modulus with respect to a plane direction. Also, such a metal terminal may vibrate or move upon being subjected to vibration or an external force. In the case where the counterpart connection portion of the metal terminal is connected by soldering to an electrode terminal of the circuit board, such vibration or movement of the metal terminal may cause an electrical disconnection or cracking in the solder connection.

As discussed above, the conventional connector is low in positional stability of the metal terminal. Thus, the press-fitting of the metal terminal into the press-fit hole thereby involves the risk of occurrence of the above-mentioned problems.

BRIEF SUMMARY OF THE INVENTION

Advantageously, the present invention addresses the above-mentioned problems and others. The invention has at least the following objects: 1) to prevent the occurrence of deformation of a metal terminal when the metal terminal and a sealing elastic member are press-fit into a press-fit hole of a connector housing; and 2) to stably hold, within the press-fit hole, the metal terminal.

According to one aspect of the invention, a connector includes a metal terminal and a sealing elastic member. The metal terminal defines a longitudinal direction, is formed of sheet metal, and is connected to an end portion of a lead wire. The metal terminal is press-fit, in a press-fit direction, into a press-fit hole formed in a connector housing made of resin by pushing a counterpart connection portion of the metal terminal located on a rear end side of the metal terminal with respect to the press-fit direction. The metal terminal includes a lead-wire connection portion located on a front end side of the metal terminal with respect to the press-fit direction. The sealing elastic member is externally attached to an end portion of the lead wire located toward the metal terminal, or to a portion of the lead wire located toward the end portion prior to press-fitting of the metal terminal into the press-fit hole. The sealing elastic member establishes a seal between an outer circumferential surface of the lead wire and a wall surface of the press-fit hole following the press-fitting of the metal terminal into the press-fit hole. The metal terminal further includes a press-fit portion between the lead-wire connection portion and the counterpart connection portion. The press-fit portion comprises a curved portion of the sheet metal of the metal terminal, which curves around an imaginary axis extending in the longitudinal direction of the metal terminal. Additionally, the metal terminal is press-fit into the press-fit hole by virtue of the press-fit portion being press-fit into the press-fit hole.

Advantageously, as compared with a conventional metal terminal comprising or assuming the form of an elongated narrow flat sheet (i.e., a flat strip), the metal terminal of this aspect of the invention has increased compression strength and flexural strength along the imaginary axis. Therefore, the metal terminal of this aspect of the invention very effectively prevents the occurrence of deformation, such as flexing, folding, or buckling, during press-fitting of the terminal and in use.

Preferably, the press-fit portion of the metal terminal comprises a U-shaped portion as viewed in cross section taken perpendicular to the imaginary axis, and the wall surface of the press-fit hole includes rotation preventing portions with which shanks of the U-shaped portion are respectively engaged so as to prevent the press-fit portion press-fit into the press-fit hole from turning about the imaginary axis. Further, in a state where the press-fit portion is press-fit into the press-fit hole, the shanks of the U-shaped portion are engaged with the respective rotation preventing portions. Advantageously, this configuration reliably prevents the press-fit portion of the metal terminal from rotating about the imaginary axis within the press-fit hole.

In accordance with one implementation, the press-fit portion includes a projection which, in a state where the press-fit portion is press-fit into the press-fit hole, bites into the wall surface of the press-fit hole.

In accordance with another implementation, the press-fit portion includes at least one projection provided at each end of the shanks of the U-shaped press-fit portion and on the exterior of a bottom part of the U-shaped portion, which, in use, each bite into the wall surface of the press-fit hole.

Advantageously, the projections biting into the wall surface of the press-fit hole effectively prevents an axial movement of the metal terminal, such as detachment of the metal terminal from the connector housing.

According to another aspect of the invention, an assembly includes a circuit-board-mounting case including the connector as described above, wherein the connector is attached to the circuit-board-mounting case with the lead wire extending to the exterior of the connector, and in which the counterpart connection portion of the metal terminal is connected to an electrode terminal of a circuit board mounted within the circuit-board-mounting case. Advantageously, the circuit-board-mounting case exhibits a highly reliable connection between the counterpart connection portions of the metal terminals and the electrode terminals of the mounted circuit board.

According to yet another aspect of the invention, a connector assembly includes a metal terminal, a lead wire, a connector housing and a sealing member. The metal terminal defines a longitudinal direction and is formed of sheet metal. The metal terminal comprises: a lead-wire connection portion located on a front end side of the metal terminal with respect to a press-fit direction; a counterpart connection portion located on a rear end side of the metal terminal with respect to the press-fit direction; and a press-fit portion located between the lead-wire connection portion and the counterpart connection portion, the press-fit portion comprising a curved portion of the sheet metal, which curves around an imaginary axis extending in the longitudinal direction. The lead wire comprises an end portion connected to the lead-wire connection portion of the metal terminal and comprising an outer circumferential surface. The connector housing comprises a press-fit hole having a wall surface. The press-fit portion of the metal terminal is press-fit into the press-fit hole. The sealing member provides a seal between the outer circumferential surface of the lead wire and the wall surface of the press-fit hole.

Other features and advantages of the invention will be set forth in, or apparent from, the detailed description of the exemplary embodiments of the invention found below.

DETAILED DESCRIPTION OF EXEMPLARY EMBODIMENTS OF THE INVENTION

Figure 1:
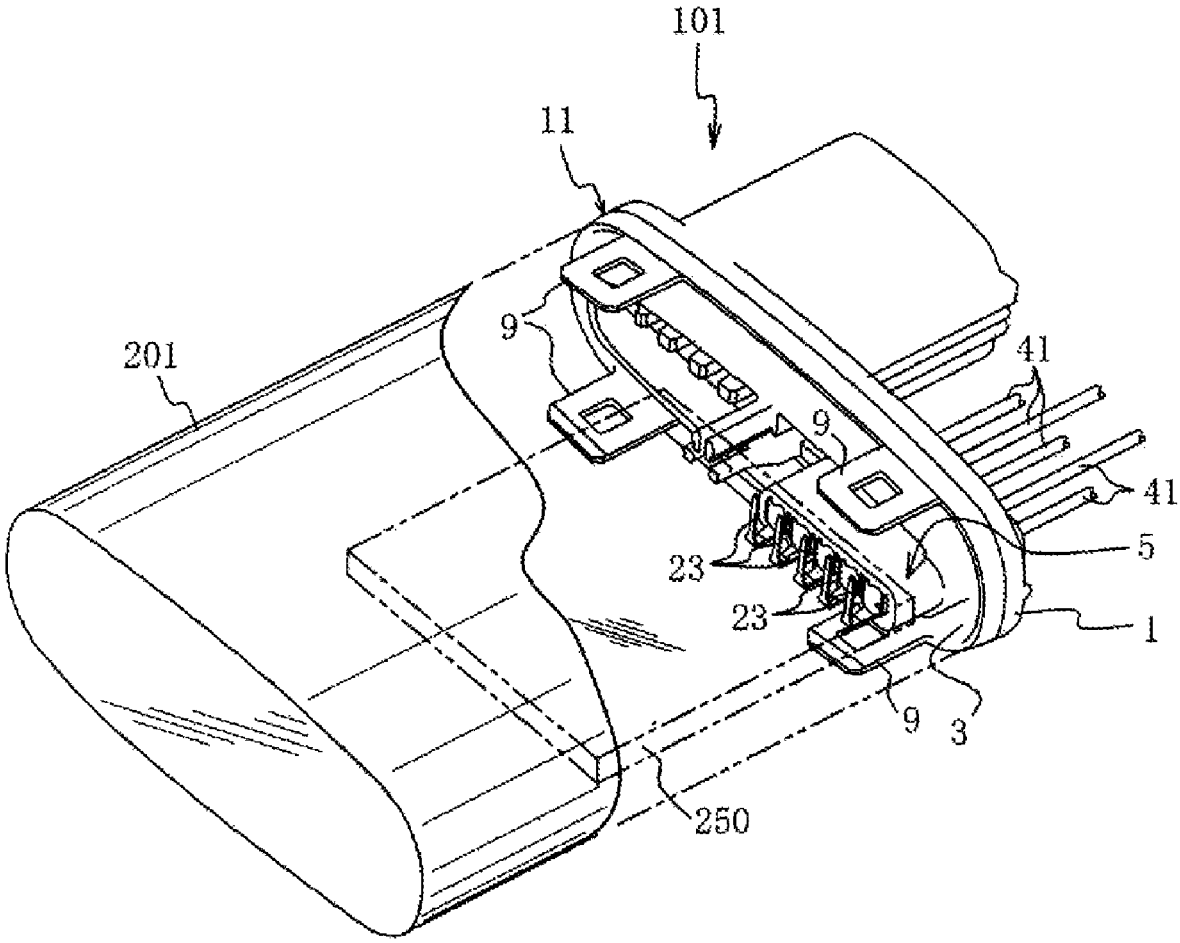
FIG. 1 is a perspective view with selected portions cut away of a connector of an exemplary embodiment of a connector and circuit-board-mounting case according to the present invention.
Figure 2:
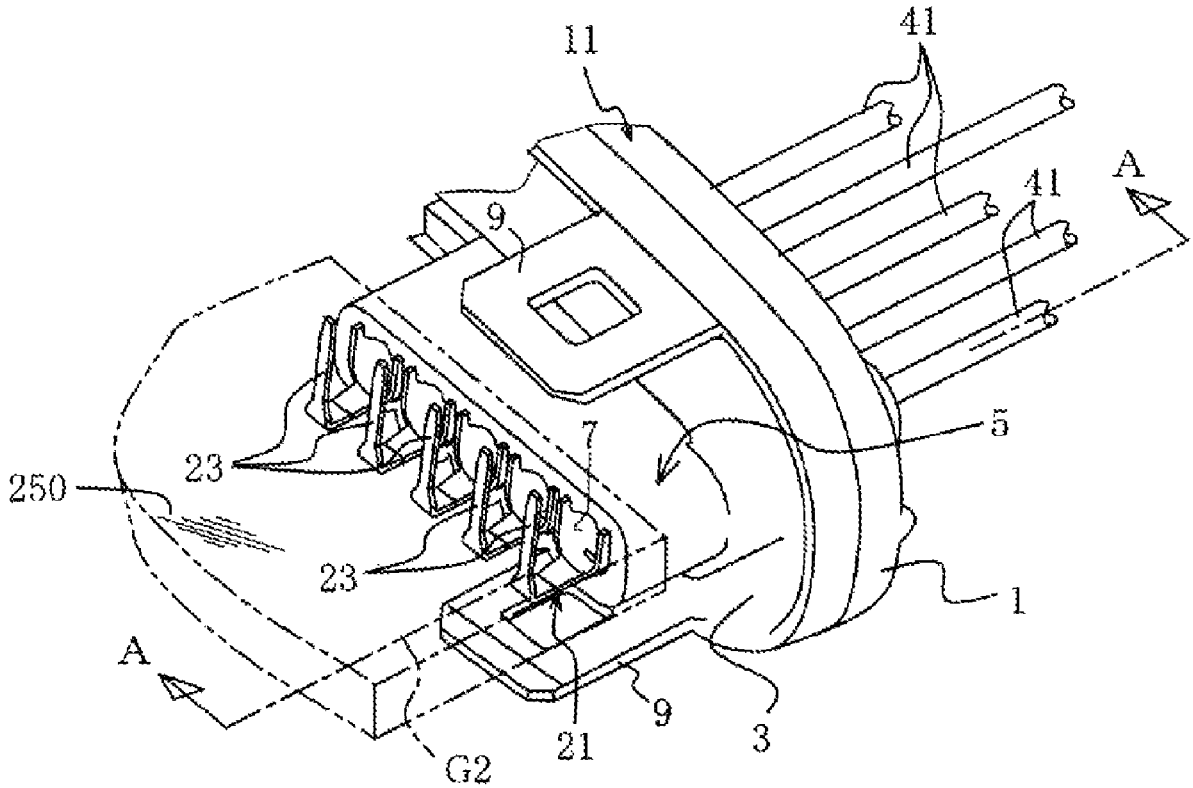
FIG. 2 is an enlarged view of selected portions of the view of FIG. 1.
Figure 3:
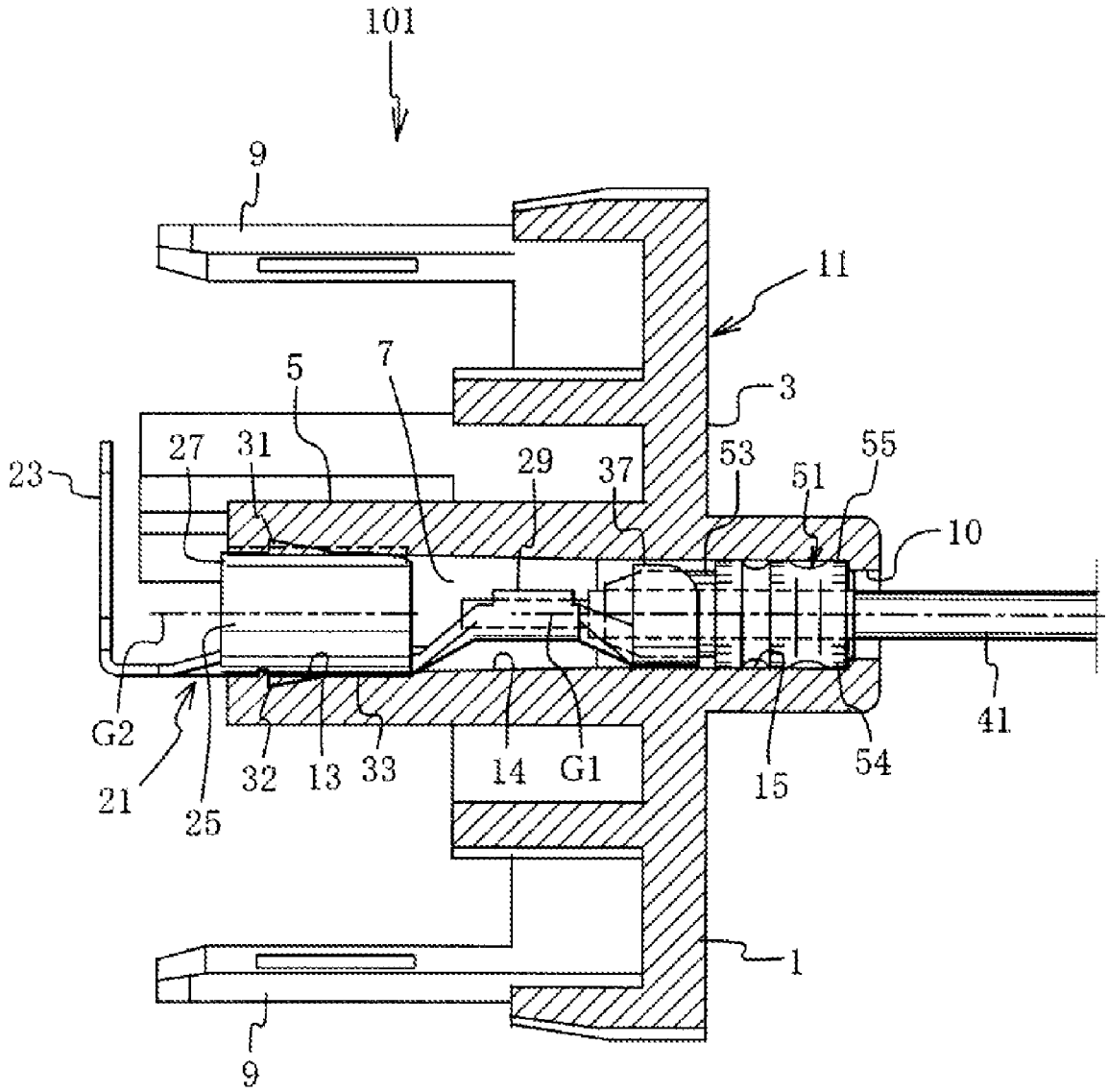
FIG. 3 is a side sectional view taken along line A-A of the connector of FIG. 2.

FIG. 1 and FIG. 2 are partially cutaway perspective views of an exemplary embodiment of the invention, showing a state where a connector 101 is attached to an opening of a circuit-board-mounting case 201. The connector 101 of the exemplary embodiment includes: a connector housing body 1 made of, for example, resin and having a narrow elongated-circular (or elliptical) outline; a connector housing 11 having a press-fit-hole formation portion 5, which is located toward one end (right end in FIG. 1 and FIG. 2) of the elongated-circular outline and is formed integrally with a body wall portion 3 of the connector housing body 1 in such a manner as to project from the body wall portion 3 toward the left near side and toward the far right side in the illustration (FIG. 1 and FIG. 2); and metal terminals 21, which, as shown in FIG. 3, are press-fit into a plurality (five in the illustration) of respective press-fit holes 7 juxtaposed in the press-fit-hole formation portion 5. As shown in FIG. 1 and FIG. 2, the connector 101 of the present exemplary embodiment is attached to an opening of a circuit-board-mounting case 201, which is illustrated in such a manner that its left portion is cut away and illustrated by lines made of one long dash alternating with two short dashes. Each of free end portions (left end portions in FIGS. 1 and 2) of the metal terminals 21 is L-shaped (i.e., assumes a shape resembling the letter L). Free ends of the metal terminals 21 which extend upright in FIGS. 1 through 3 serve as counterpart connection portions 23. The counterpart connection portions 23 are soldered to respective electrode terminals (not shown) of a circuit board 250 mounted within the circuit-board-mounting case 201 while being inserted through respective through-hole conductors (not shown) of the circuit board 250. Projecting pieces 9 each having a rectangular engagement hole are provided for engagement on the connector housing body 1 having an elongated-circular outline. When the connector 101 is attached to the opening of the circuit-board-mounting case 201, the projecting pieces 9 are fixedly engaged with respective protrusions provided around the opening.

Figure 6:
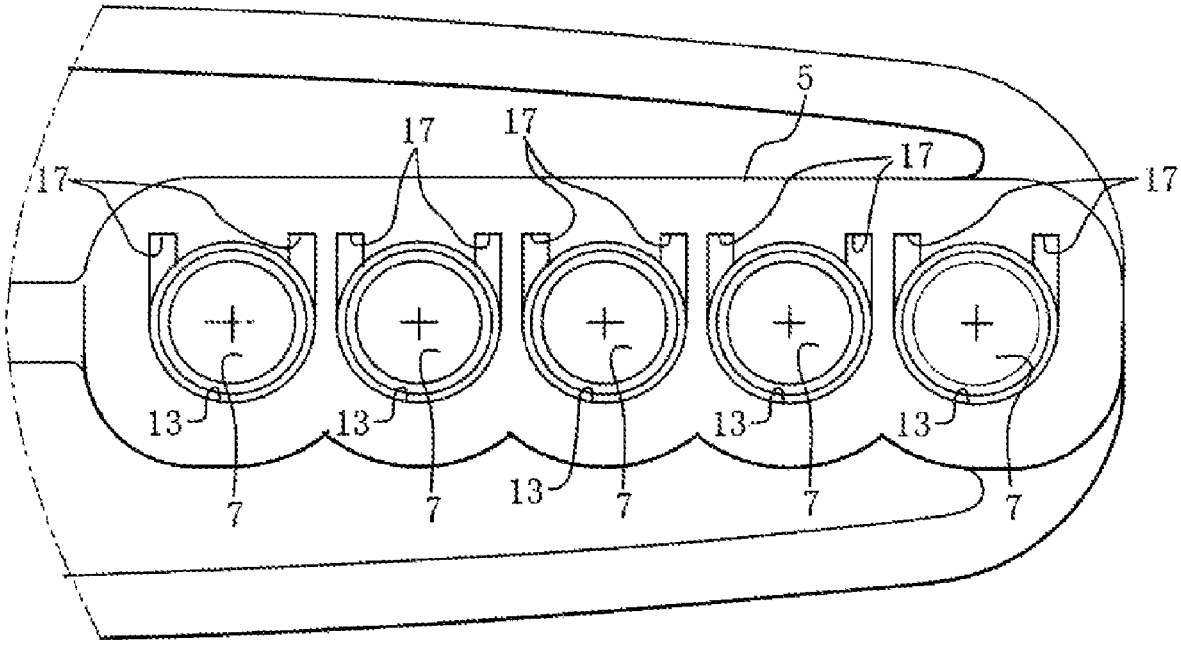
FIG. 6 is a partial front elevational view of the connector housing of FIG. 4, showing the press-fit holes as viewed from an inlet side.
Figure 7:
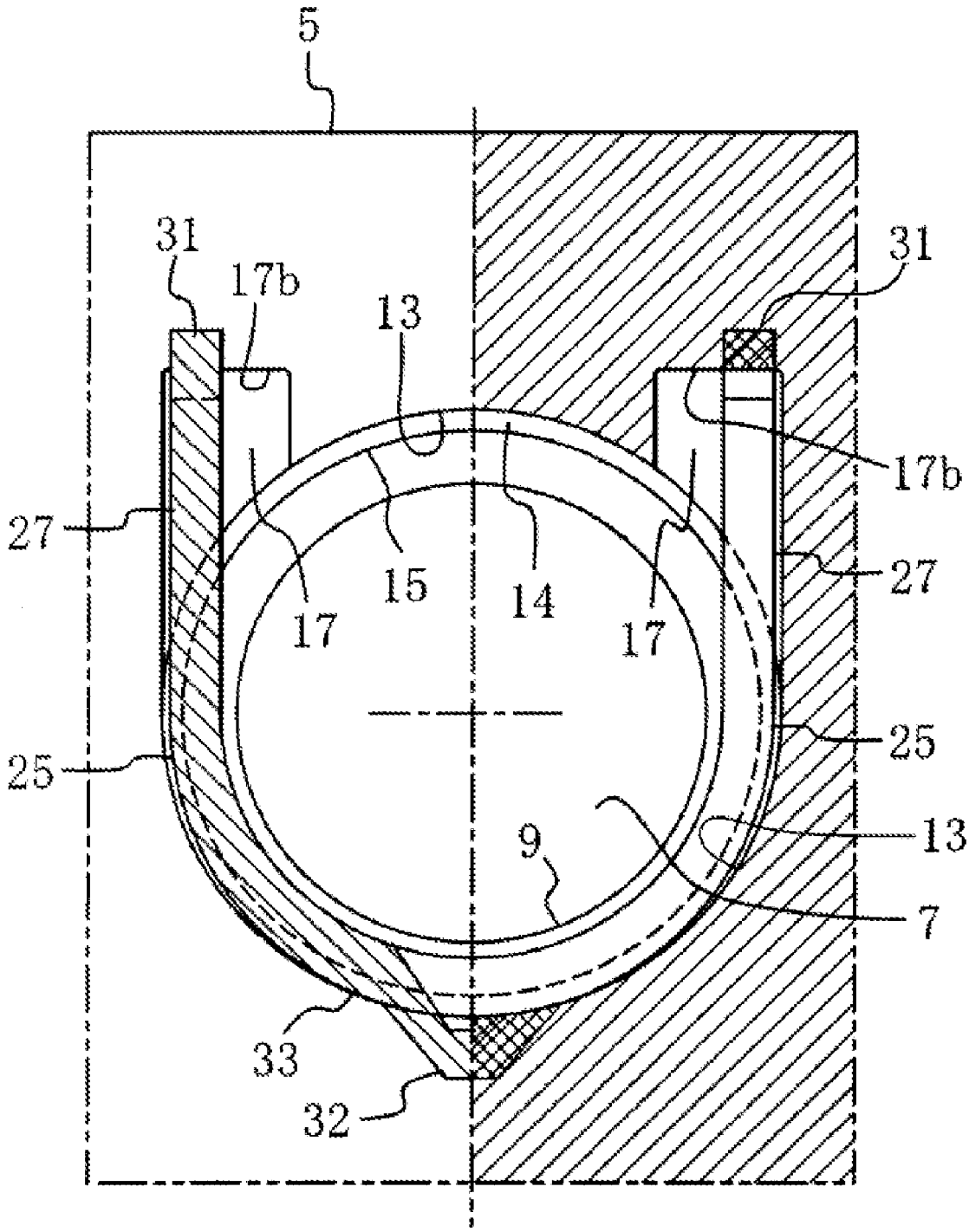
FIG. 7 is an enlarged half-sectional view of a selected portion of the connector housing of FIG. 6 and an exemplary metal terminal that has been press-fit therein, showing a state wherein a press-fit portion of the exemplary metal terminal is press-fit into an exemplary press-fit hole.
Figure 8:
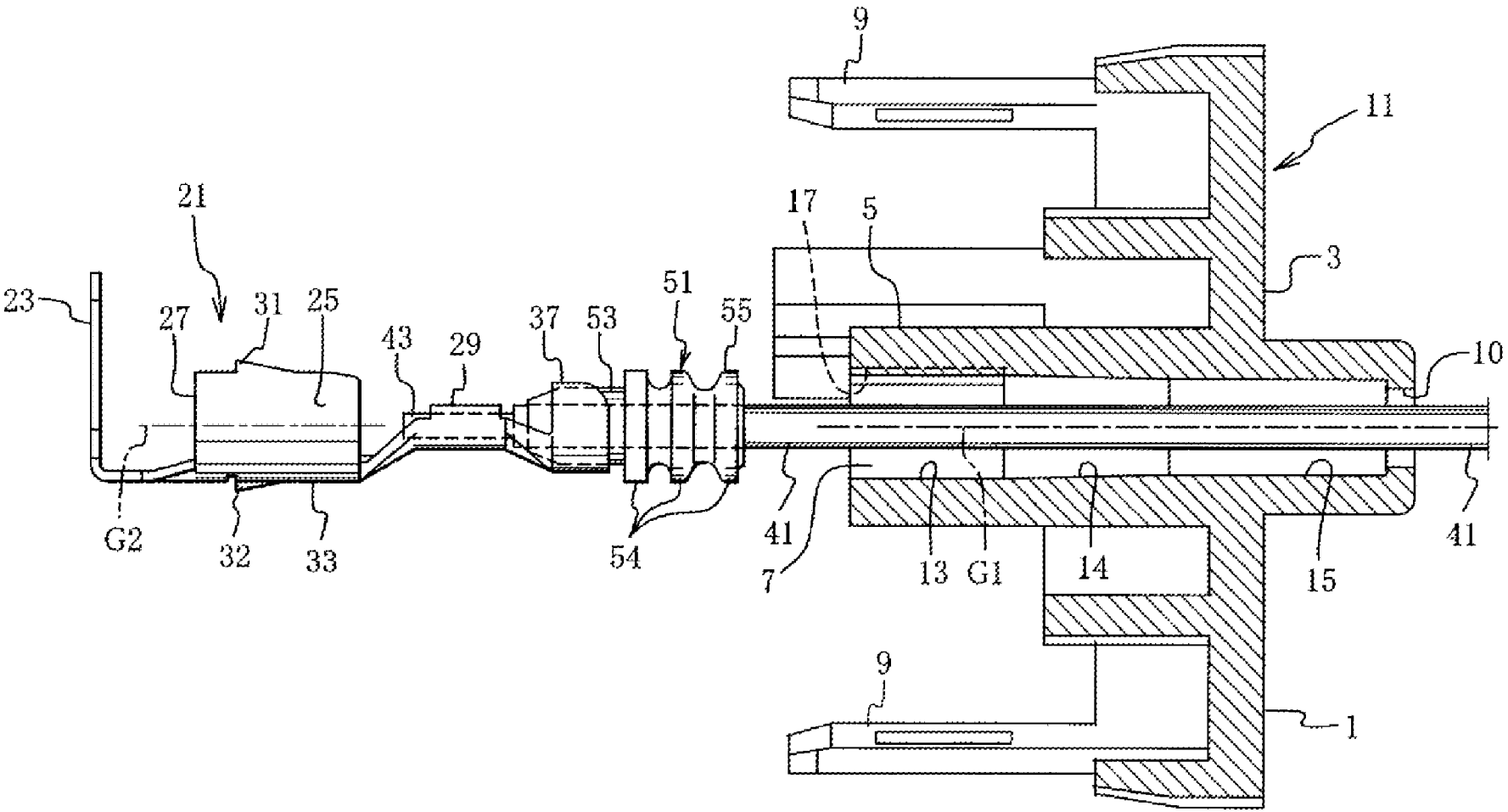
FIG. 8 is a side sectional view taken along line B-B of FIG. 5, showing a section which contains an axis of an exemplary press-fit hole.

As mentioned above, in the connector housing 11 of the present exemplary embodiment, five press-fit holes 7 are formed in a juxtaposed manner in the press-fit-hole formation portion 5 of the connector housing body 1 (see FIGS. 4 through 7). The metal terminals 21 are press-fit into the respective press-fit holes 7. Since the five press-fit holes 7 are of the same configuration, and the five metal terminals 21 are of the same configuration, the following description discusses one of the press-fit holes 7 and one of the metal terminals 21. As shown in FIGS. 3 and 8, the press-fit hole 7 is formed in and extends through the press-fit-hole formation portion 5, which projects from both sides of the body wall portion 3. In the present exemplary embodiment, the press-fit-hole formation portion 5 is formed such that the metal terminal 21, whose counterpart connection portion 23 is to face the interior side of the circuit-board-mounting case 201, is press-fit from the interior side (left side in FIGS. 3 and 8) of the circuit-board-mounting case 201. Thus, the press-fit hole 7 has an inward flange portion 10 configured as follows: an end portion of the press-fit-hole formation portion 5 located on a side toward the exterior of the circuit-board-mounting case 201 (at the right side in FIGS. 3 and 8) (i.e., on a side opposite the inlet of the press-fit hole 7 located at the left side in FIGS. 3 and 8) projects radially inward toward the axis (centerline) G1 of the press-fit hole 7. The inward flange portion 10 serves as a positioning stopper (butting face) for the metal terminal 21 in the process of press-fitting.

In the present exemplary embodiment, the press-fit hole 7, excluding a bore region of the inward flange portion 10, includes, from its inlet side (left side in FIGS. 3 and 8): a large-diameter portion 13, which is parallel to its axis G1 and into which a press-fit portion 25 of the metal terminal 21 is press-fit; a taper portion 14, whose diameter reduces with depth (toward the right in FIGS. 2 and 5); and a small-diameter portion 15 in parallel with the axis G1. The large-diameter portion 13, the taper portion 14, and the small-diameter portion 15 are coaxial and are basically circular in cross section. As shown in FIG. 6 and FIG. 7, as viewed in the direction of the axis G1 from the inlet side from which the metal terminal 21 is press-fit, the large-diameter portion 13 has groove portions 17, which are formed at opposite sides of the large-diameter portion 13, are cut upward, and extend in parallel with the axis G1. In the present exemplary embodiment, when the metal terminal 21 is press-fit, the groove portions 17 receive ends of respective shanks 27 of the U-shaped press-fit portion 25 of the metal terminal 21, which will be described next. Specifically, although described in detail later, in a state where the U-shaped press-fit portion 25 is press-fit with its shanks 27 being fitted into the respective groove portions 17, when the press-fit portion 25 is subjected to an action which attempts to turn the press-fit portion 25 about the axis G1 within the press-fit hole 7, the groove portions 17 engaged with the shank portions 27 prevent the press-fit portion 25 from turning. That is, in the present exemplary embodiment, the groove portions 17 serve as rotation preventing portions.

Figure 9:
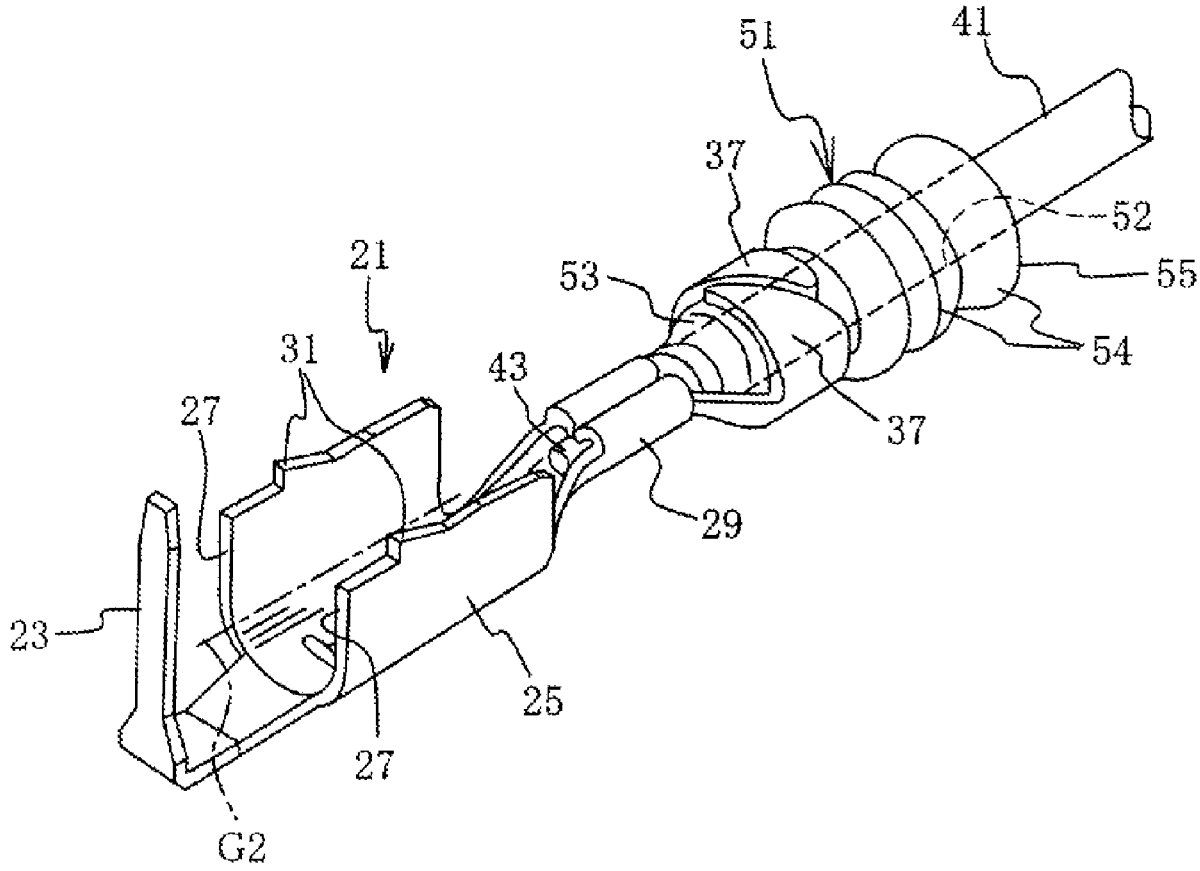
FIG. 9 is a perspective view of an exemplary metal terminal, an end portion of a lead wire, and a sealing elastic member of FIG. 4.
Figure 10:
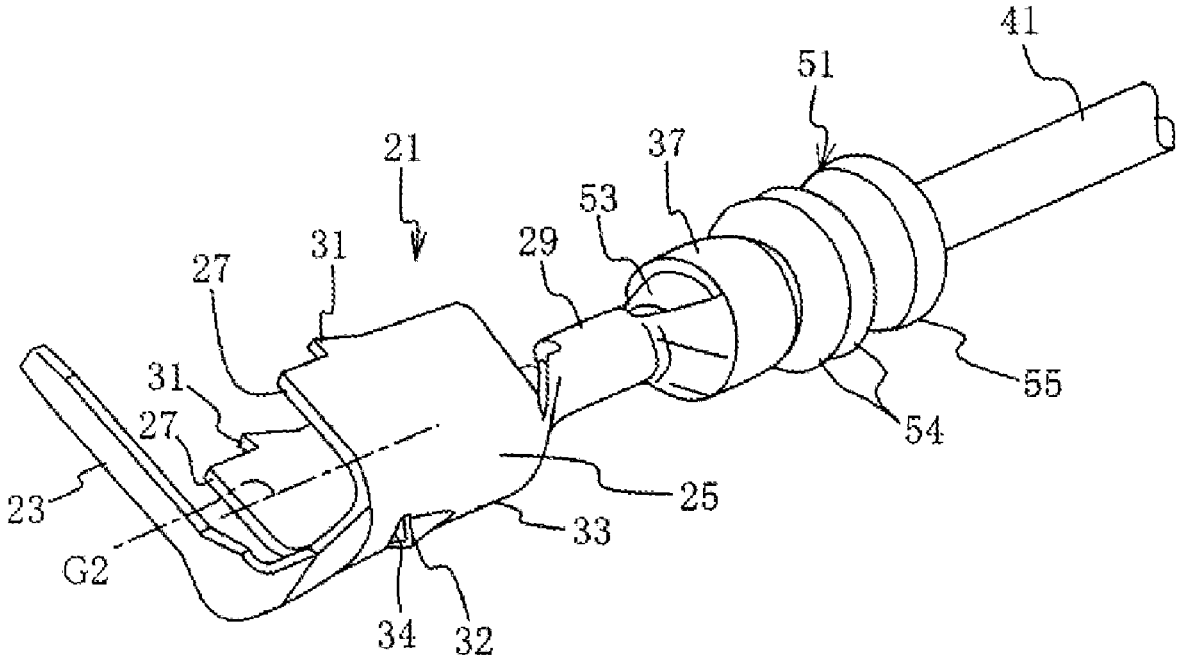
FIG. 10 is another perspective view of the exemplary metal terminal, end portion of the lead wire, and sealing elastic member of FIG. 9.

As shown in FIGS. 9 and 10, the metal terminal 21 is formed by bending a blank which has a predetermined shape and is formed from sheet metal (for example, a stainless-steel sheet) by blanking or cutting. The press-fit portion 25 is provided between the aforementioned L-shaped counterpart connection portion 23 and a lead-wire connection portion (barrel portion) 29. The press-fit portion 25 is formed by bending the blank (sheet metal) which forms the metal terminal 21, in such a manner as to be curved around an imaginary axis G2 extending in the longitudinal direction of the metal terminal 21. In the present exemplary embodiment, the press-fit portion 25 is formed into a shape resembling the letter U as viewed in its cross section taken perpendicular to the imaginary axis G2. The press-fit portion 25 has projections 31 and 32 which bite into the wall surface of the large-diameter portion 13 of the press-fit hole 7, one projection 31 each at ends of the shanks 27 of the U-shaped press-fit portion 25 and one projection 32 on the exterior of the bottom part 33 of the U-shaped press-fit portion 25. The projections 31 and 32 are located closer to the counterpart connection portion 23 than is a longitudinally middle region of the press-fit portion 25. In the present exemplary embodiment, the imaginary axis G2 coincides with the axis G1 of the press-fit hole 7.

According to the present exemplary embodiment, when the press-fit portion 25 is press-fit into the press-fit hole 7, end portions of the shanks 27 of the U-shaped press-fit portion 25 are received in the respective grooves 17 of the large-diameter portion 13 of the press-fit hole 7. In the course of the press-fit portion 25 being press-fit into the press-fit hole 7, the projections 31 formed at the ends of the respective shanks 27 of the U-shaped press-fit portion 25 scratch and bite into groove bottoms 17*b* of the respective groove portions 17, and the projection 32 formed on the exterior of the bottom part 33 of the U-shaped press-fit portion 25 scratches and bites into a circumferential wall surface of the press-fit hole 7 in such a manner as to expand the circumferential wall surface. As mentioned above, according to the present exemplary embodiment, the press-fit portion 25 is press-fit into the press-fit hole 7 while the projections 31 and 32 are strongly pressed against and bite into the wall surface of the press-fit hole 7. However, according to the present invention, regardless of whether the projections 31 and 32 are present, it is good practice for the press-fit portion 25 in a free state to have a diametral size (outside diameter) greater than the diameter (hole size) of the press-fit hole 7, so that the press-fit portion 25 is press-fit into the press-fit hole 7 by the effect of it flat-spring property or elasticity. Notably, the diametral size of the press-fit portion 25 may be determined according to a desired interference for press-fitting (i.e., a tight fit). Each of the projections 31 and 32 is formed into such a sloped (triangular) shape that the amount of projection increases from a side toward the lead-wire connection portion 29 to a side toward the counterpart connection portion 23. By virtue of this, in the course of the press-fit portion 25 being press-fit into the press-fit hole 7, the projections 31 and 32 can slide on the wall surface of the press-fit hole 7 in a relatively smooth manner while pressing or biting into the wall surface of the press-fit hole 7. However, once the press-fit portion 25 is press-fit into the press-fit hole 7, the projections 31 and 32 activate their effect of preventing detachment of the press-fit portion 25. As illustrated, the projections 31 formed at the ends of the respective shanks 27 of the U-shaped press-fit portion 25 are formed by forming respective sawtooth shapes in the process of cutting material. The projection 32 formed on the exterior of the bottom 33 of the U-shaped press-fit portion 25 is formed as a cut 34 perpendicular to the imaginary axis G2 formed in a region of the press-fit portion 25 located toward the counterpart connection portion 23. Pressing is performed along the cut 34 from the interior of the press-fit portion 25 to the exterior of the press-fit portion 25 such that a pressed portion assumes the form of a triangular pyramid. Notably, the number and shape of the projections 31 and 32 can be selected as appropriate.

The lead-wire connection portion (barrel portion) 29 is wound and crimped onto an end portion (an end portion of a conductor) 43 of the lead wire 41 to electrically and mechanically connect the metal terminal 21 to the lead wire 41. In the metal terminal 21 of the present exemplary embodiment, the lead-wire connection portion 29 has two laterally provided sealing-elastic-member-fixing portions 37. The sealing-elastic-member-fixing portions 37 are located on a side opposite the counterpart connection portion 23. The sealing-elastic-member fixing portions 37 are wound and crimped onto a small-diameter portion 53 of a sealing elastic member 51, which will be described next. The sealing elastic member 51 assumes a tubular form, and is externally fitted to a portion (an insulating-resin-layer portion) of the lead wire 41 located toward the end portion 43 of the lead wire 41. By this configuration, the sealing elastic member 51 is firmly fixed onto the lead wire 41.

The sealing elastic member 51 has a bore 52 through which the lead wire 41 can be inserted under the condition that its outer circumferential surface (insulating resin layer) is in close contact with the wall surface of the bore 52. Also, the sealing elastic member 51 integrally has, on its outer circumferential surface, a large-diameter portion 55 and the above-mentioned small-diameter portion 53, thereby assuming a stepped cylindrical form. The large-diameter portion 55 has a single or a plurality of lips 54 formed circumferentially (annularly) on its outer circumferential surface and is used for press-fitting. The small-diameter portion 53 is located on a side toward the counterpart connection portion 23 of the metal terminal 21 with respect to the large-diameter portion 55 of press-fitting use. In the present exemplary embodiment, the sealing elastic member 51 is made of synthetic rubber. The small-diameter portion 53 is formed such that, in a state where the lead wire 41 is inserted through the bore 52 of the sealing elastic member 51, the sealing-elastic-member-fixing portions 37 of the metal terminal 21 are wound and crimped onto the small-diameter portion 53, thereby firmly fixing the sealing elastic member 51 onto the lead wire 41. The outside diameter of the lips 54 of the large-diameter portion 55 is determined such that, when the press-fit portion 25 of the metal terminal 21 is press-fit into the press-fit hole 7, the lips 54 of the large-diameter portion 55 are in a press-fit condition within the small-diameter portion 15 located deep in the press-fit hole 7, thereby establishing a seal. The size of the small-diameter portion 53 of the sealing elastic member 51 is determined such that the small-diameter portion 15 located deep in the press-fit hole 7 can receive the small-diameter portion 53 onto which the sealing-elastic-member-fixing portions 37 are wound and crimped.

In the present exemplary embodiment, the lead wire 41 is inserted through the press-fit hole 7 from the exterior of the connector housing 11 such that its end portion projects to an inner side of the connector housing 11 (on a case connection side). The projecting end portion of the lead wire 41 is inserted through the bore 52 of the sealing elastic member 51 such that the sealing elastic member 51 is located at an appropriate position on an end portion of the lead wire 41 (or on a portion located toward the end portion). Then, the sealing-elastic-member-fixing portions 37 of the metal terminal 21 are wound and crimped onto the small-diameter portion 53 of the sealing elastic member 51, and the lead-wire connection portion (barrel portion) 29 of the metal terminal 21 is wound and crimped onto an end portion (the exposed end portion 43 of a conductor) of the lead wire 41 (see FIGS. 4, 5 and 8). By means of the sealing-elastic-member-fixing portions 37 being wound and crimped onto the sealing elastic member 51, a seal is maintained between the outer circumferential surface (insulating resin layer) of the lead wire 41 and the inner surface (the wall surface of the bore 52) of the sealing elastic member 51.

Figure 4:
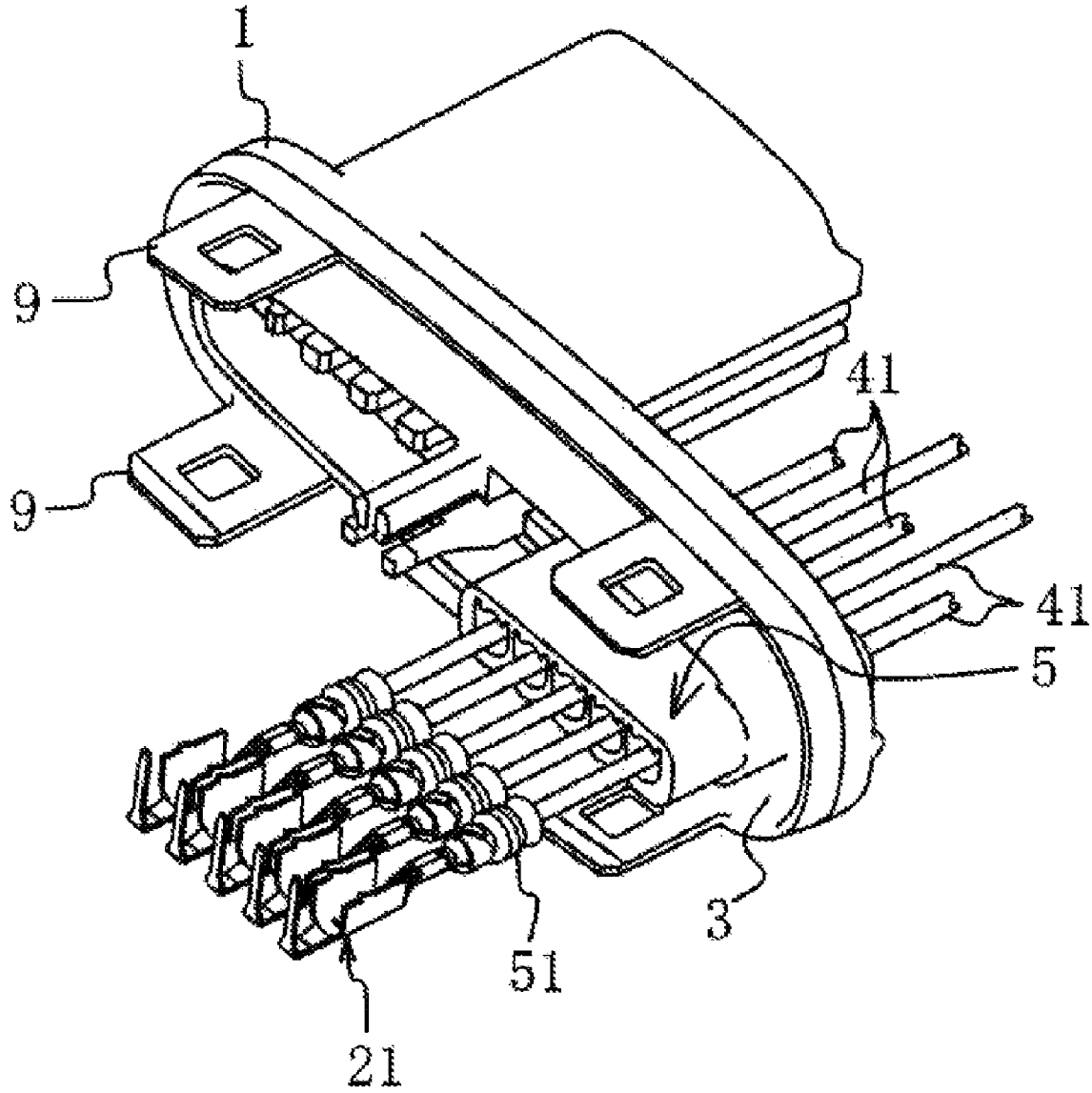
FIG. 4 is a perspective view of the connector of FIG. 1, showing a state before metal terminals are press-fit into press-fit holes of a connector housing.
Figure 5:
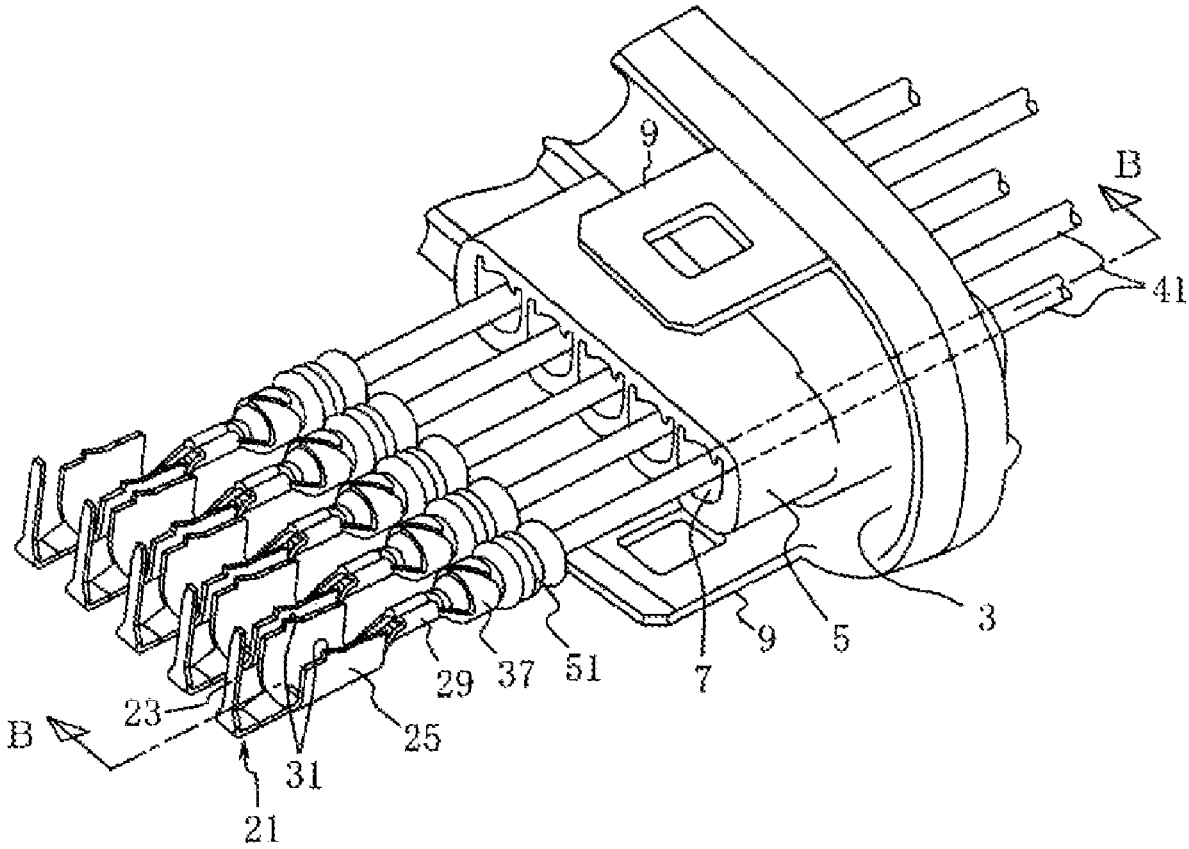
FIG. 5 is an enlarged view of selected portions of the view of FIG. 4.
Figure 11:
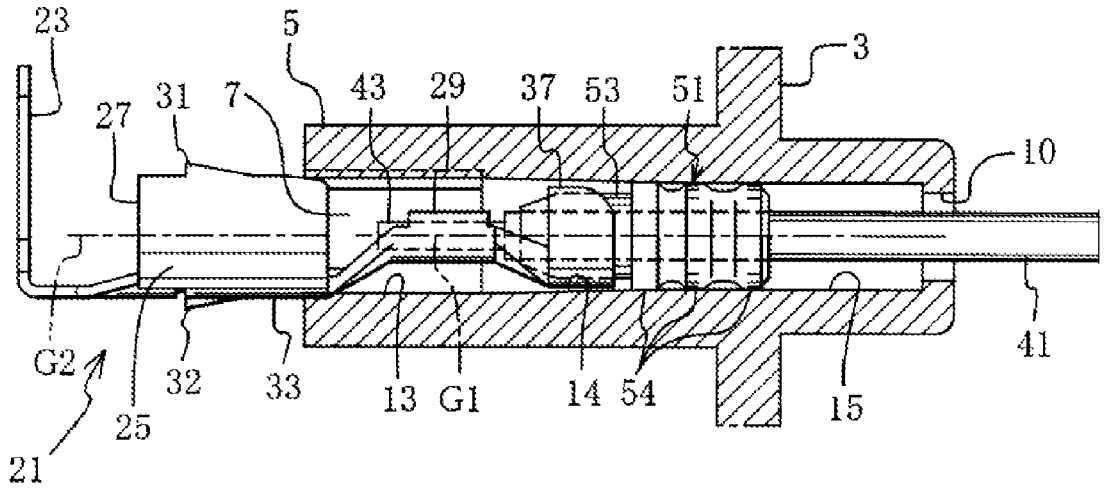
FIG. 11 is a side sectional view of an exemplary connector, showing a state where a metal terminal is in the midst of being press-fit into a press-fit hole of a connector housing.

Next, in the condition shown in FIGS. 4, 5 and 8, the lead wire 41 is pulled from the exterior of the connector 101. Also, the metal terminal 21, which is formed of sheet metal and connected to an end portion of the lead wire 41, is press-fit into the press-fit hole 7, with the lead-wire connection portion 29 being located on the front side of the metal terminal with respect to the press-fitting direction, by pressing the counterpart connection portion 23 located on the front side of the metal terminal with respect to the press-fitting direction. That is, the large-diameter portion 55 of the sealing elastic member 51 is press-fit into the press-fit hole 7 from the inlet of the press-fit hole 7, and then the press-fit portion 25 of the metal terminal 21 is press-fit into the press-fit hole 7 from the inlet (see FIG. 11). The press-fitting work continues until, as shown in FIG. 3, the leading end of the large-diameter portion 55 of the sealing elastic member 51 comes into contact with the inward flange portion 10 located at the bottom of the press-fit hole 7. By this procedure, the press-fitting work is completed, whereby the metal terminal 21 connected to the lead wire 41 is assembled to the connector housing 11. At this time, the sealing elastic member 51 (mainly its large-diameter portion 55) is pressed against the wall surface of the press-fit hole 7 and is thus deformed in such a manner as to be radially crushed. This establishes a seal (watertightness). According to the present exemplary embodiment, when the metal terminal 21 is to be press-fit into the press-fit hole 7, as shown in FIG. 7, ends of the shanks 27 of the U-shaped press-fit portion 25 are aligned with the respective groove portions 17 at the inlet of the press-fit hole 7 before the press-fitting work is started. FIG. 7 shows a state where the projections 31 and 32 bite into the groove portions 17 and into the wall surface of the large-diameter portion 13 of the press-fit hole 7, respectively, in an exaggerated manner by crosshatching. The left half of FIG. 7 shows the press-fit portion 25 in section, and the press-fit hole 7 as viewed from the inlet side. The right half of FIG. 7 shows the large-diameter portion 13 of the press-fit hole 7 in section, and the press-fit portion 25 with the solid line.

According to the present exemplary embodiment, such press-fitting work is accompanied by press-fit resistance between the wall surface of the press-fit hole 7 and the outer circumferential surface of the sealing elastic member 51 and press-fit resistance between the wall surface of the press-fit hole 7 and the press-fit portion 25 of the metal terminal 21. According to the present exemplary embodiment, press-fitting work is additionally accompanied by resistance caused by the projections 31 and 32 of the press-fit portion 25 biting into the wall surface of the press-fit hole 7, and resistance caused by friction of the projections 31 and 32 against the wall surface of the press-fit hole 7. Thus, press-fitting work requires a considerably large press-in force. Meanwhile, according to the present exemplary embodiment, the press-fit portion 25 has a U-shaped cross-sectional shape (i.e., a shape resembling the letter U). Thus, as compared with the conventional metal terminal assuming the form of an elongated narrow flat sheet extending in the longitudinal direction, compression strength and buckling strength along the longitudinal direction is higher. By virtue of this, the occurrence of deformation, such as folding or buckling, of the metal terminal 21 can be effectively prevented. Furthermore, such an increase in strength can prevent the occurrence of deformation of the press-fit portion 25 after press-fitting.

Figure 12:
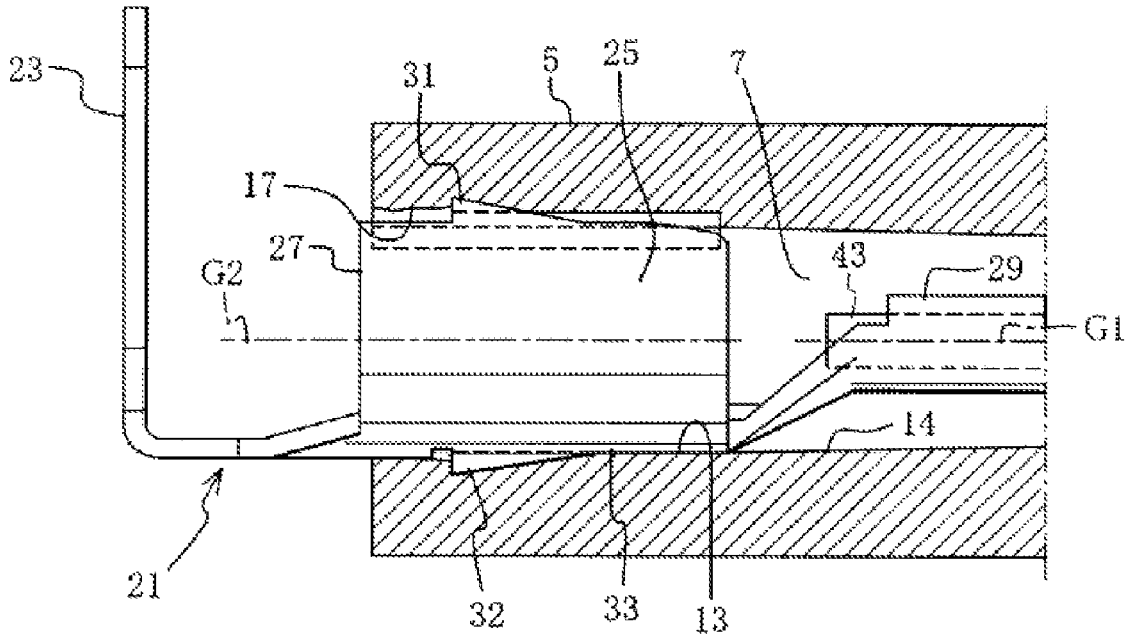
FIG. 12 is an enlarged view of selected portions of the view of FIG. 3.

Furthermore, according to the present exemplary embodiment, the metal terminal 21 undergoes press-fitting work in a state where the ends of the shanks 27 of the U-shaped press-fit portion 25 are received in the respective groove portions 17. Thus, as shown in FIG. 12, in the course of press-fitting of the metal terminal 21, the projections 31 formed at the ends of the respective shanks 27 of the U-shaped press-fit portion 25 bite into or scratch the groove bottoms 17*b* of the respective groove portions 17 while being strongly pressed against the groove bottoms 17*b*. Also, the projection 32 formed on the exterior of the bottom 33 of the U-shaped press-fit portion 25 similarly bites into or scratches the circular wall surface of the press-fit hole 7 in the course of press-fitting. This press-fit condition effectively prevents the press-fit portion 25 from turning about the aforementioned imaginary axis G2 after press-fitting. Particularly, according to the present exemplary embodiment, press-fitting is carried out while the shanks 27 are received in the respective groove portions 17, markedly yielding the effect of preventing the turning of the press-fit portion 25. Furthermore, after press-fitting, the projections 31 and 32 bite into associated wall surfaces of the press-fit hole 7. Also, the projections 31 and 32 assume respective shapes which are effective against detachment from the press-fit hole 7. Therefore, the metal terminal 21 of the present exemplary embodiment is held with high stability even after press-fitting.

As mentioned briefly in the above description, as shown in FIG. 1, the thus-configured connector 101 is attached to the circuit-board-mounting case 201 while the lead wires 41 extend to the exterior of the connector 101. The ends of the L-shaped counterpart connection portions 23 of the metal terminals 21 are inserted through and soldered to respective electrode terminals (through-hole conductors) of the circuit board 250 accommodated within the circuit-board-mounting case 201, whereby the circuit-board-mounting case 201 having the connector 101 is completed. In the thus-obtained circuit-board-mounting case 201, the metal terminals 21 are held with high stability after press-fitting. Thus, even upon subjection to vibration or the like, the occurrence of defect in the solder connections and the like can be effectively prevented.

The above exemplary embodiment is described while mentioning the rotation preventing portions which are formed in the wall surface of the large-diameter portion 13 of the press-fit hole 7 and function as follows: in a state where the press-fit portion 25 is press-fit into the large-diameter portion 13 of the press-fit hole 7, the shanks 27 of the U-shaped press-fit portion 25 are engaged with the rotation preventing portions, thereby preventing the press-fit portion 25 from turning about the imaginary axis G2. More specifically, as viewed in the direction of the axis G1 from the inlet side of the press-fit hole 7, the press-fit hole 7 has the groove portions 17, which are formed at opposite sides of the press-fit hole 7, are cut in the wall surface of the press-fit hole 7, and receive the ends of the respective shanks 27 of the U-shaped press-fit portion 25. The shanks 27 of the U-shaped press-fit portion 25 are press-fit into the respective groove portions 17 to thereby be prevented from turning about the imaginary axis G2. However, the present invention is not limited to such rotation preventing portions.

Figure 13:
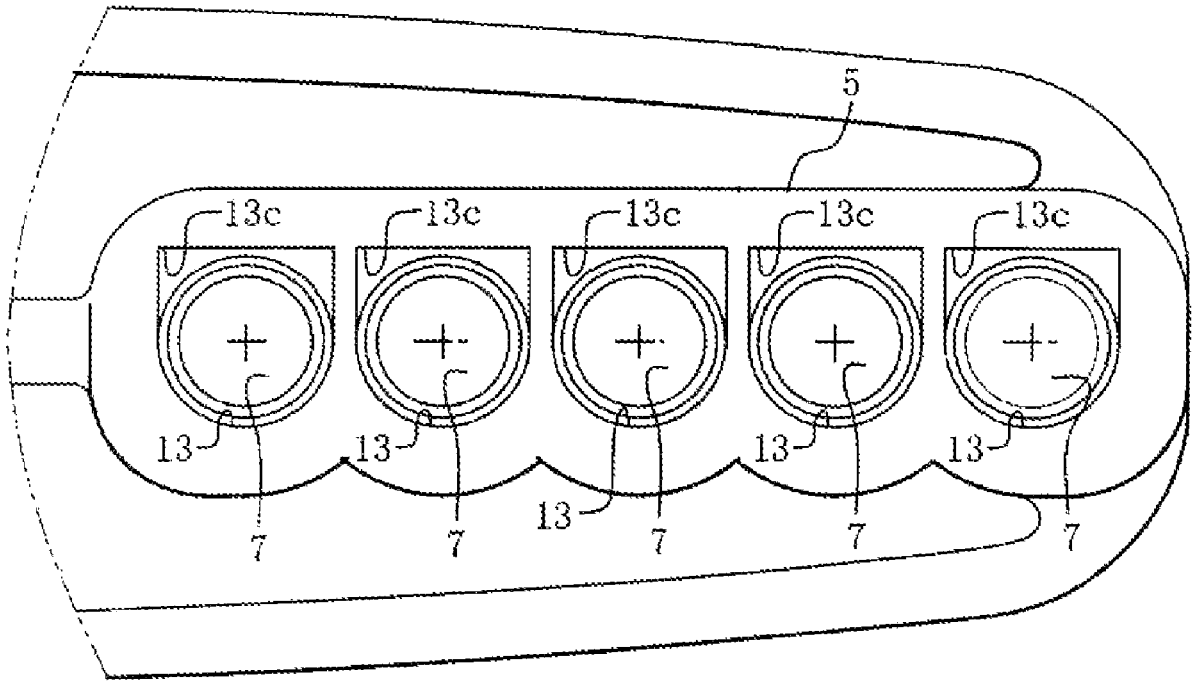
FIG. 13 is a partial front elevational view of an alternate connector housing, showing the press-fit holes as viewed from an inlet side.
Figure 14:
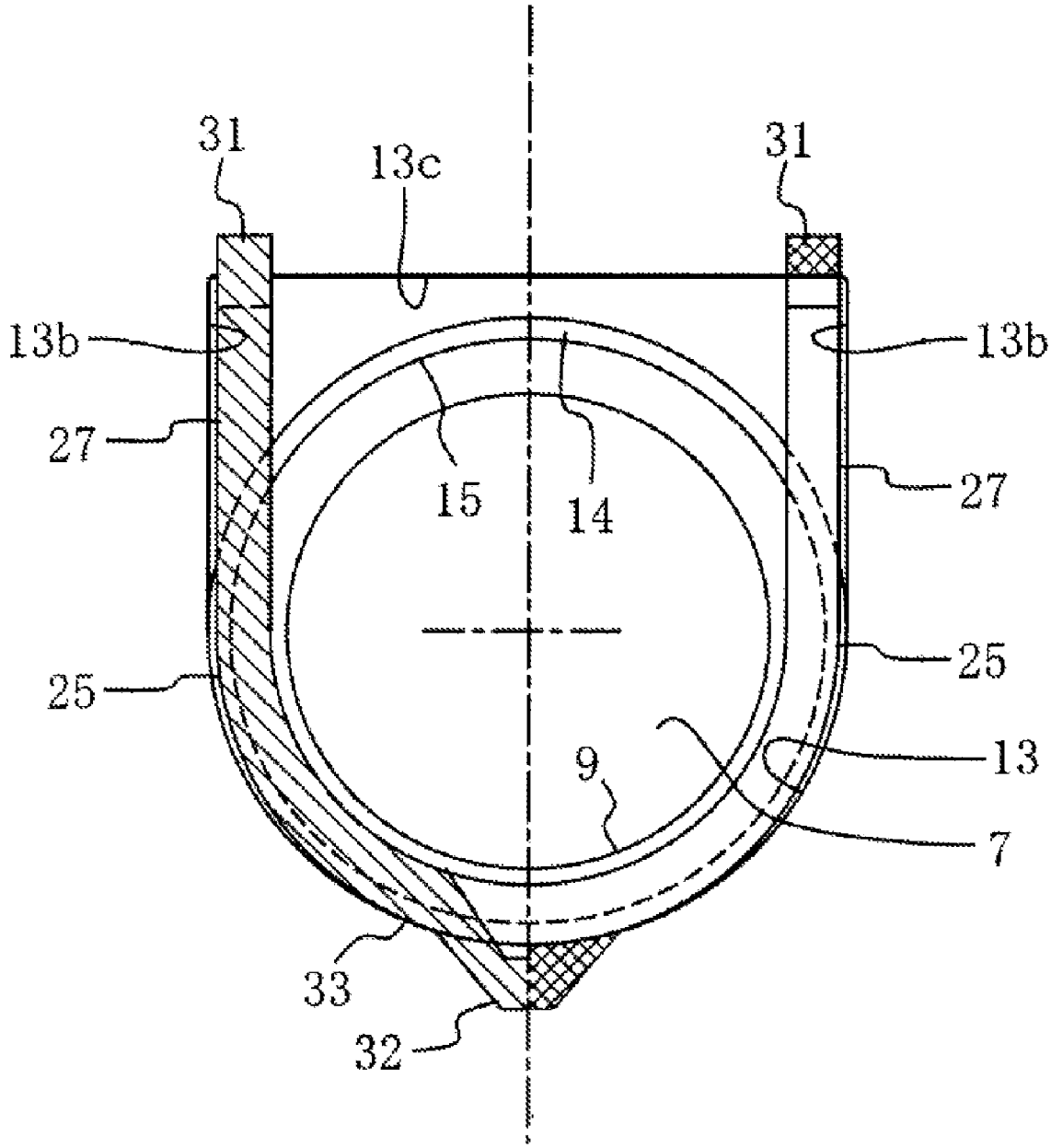
FIG. 14 is an enlarged half-sectional view of a selected portion of the connector housing of FIG. 13 and an exemplary metal terminal that has been press-fit therein, showing a state wherein a press-fit portion of the exemplary metal terminal is press-fit into an exemplary press-fit hole

For example, the rotation preventing portions may assume the form shown in FIG. 13 and FIG. 14. Specifically, as viewed in the direction of the axis G1 from the inlet side of the large-diameter portion 13 of the press-fit hole 7 of the above-described exemplary embodiment, the large-diameter portion 13 of the press-fit hole 7 does not have a circular cross section, but has a U-shaped cross section corresponding to the U shape of the press-fit portion 25. The ends of the shanks 27 of the U-shaped press-fit portion 25 are latched to respective opposite side surfaces (wall surfaces) 13*b* of the press-fit hole 7. In this case, the projection 32 formed on the exterior of the bottom 33 of the U-shaped press-fit portion 25 bites into the circular surface of the press-fit hole 7 as in the case of the above-described exemplary embodiment, whereas, as shown in FIG. 14, the projections 31 formed at the ends of the respective shanks 27 of the U-shaped press-fit portion 25 bite into an illustrated ceiling surface 13*c* of the large-diameter portion 13 of the press-fit hole 7 in respective regions located toward the left and right corners of the large-diameter portion 13. In FIG. 13 and FIG. 14, structural features corresponding to those of FIG. 6 and FIG. 7 are denoted by like reference numerals.

According to the above-described exemplary embodiment, the press-fit portion 25 of the metal terminal 21 is formed into a shape resembling the letter U as viewed in its cross section taken perpendicular to the imaginary axis G2. Thus, regardless of whether biting projections or anti-detachment projections are present, the press-fit portion 25 is effectively prevented from turning about the imaginary axis G2. However, the present invention is not limited to the U shape for the shape of the press-fit portion 25. In view of achievement of the first object of the present invention, the following configuration may be employed. The metal terminal 21 has the press-fit portion 25 between the lead-wire connection portion 29 and the counterpart connection portion 23, the press-fit portion 25 being formed by curving the sheet metal which forms the metal terminal 21, in such a manner as to be curved around the imaginary axis G2 extending in the longitudinal direction of the metal terminal 21, and the press-fit portion 25 is press-fit into the press-fit hole 7.

Figure 15:
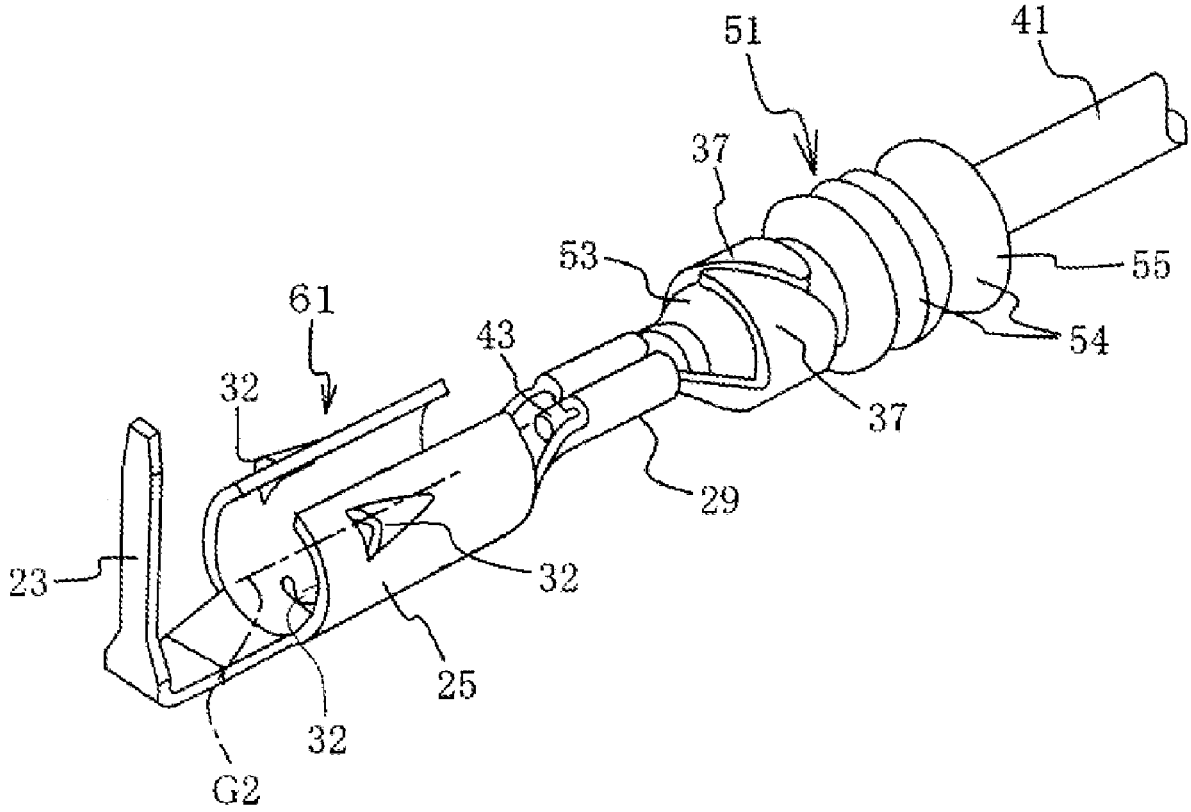
FIG. 15 is a perspective view of an alternate metal terminal, an end portion of a lead wire, and a sealing elastic member.
Figure 16:
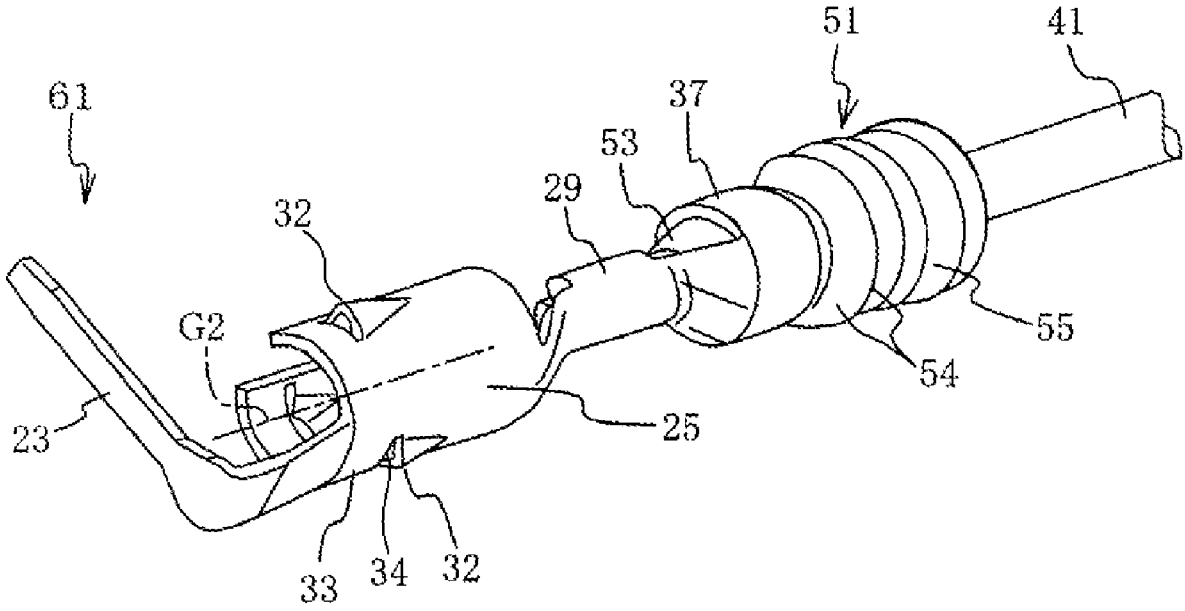
FIG. 16 is another perspective view of the exemplary metal terminal, end portion of the lead wire, and sealing elastic member of FIG. 15.

Thus, as in the case of a variant metal terminal 61 shown in FIGS. 15 and 16, the press-fit portion 25 may be formed by curving the sheet metal which forms the metal terminal 61, in such a manner as to be curved around the imaginary axis G2 in a C-shaped cylindrical form. In this case, necessary configurational features are as follows: the press-fit hole of the connector housing has a circular cross section taken perpendicular to its axis (hole centerline); and the press-fit portion 25 of the metal terminal 61 in a free state has an outside diameter which is greater than the diameter of the press-fit hole by a press-fit interference. Specifically, in the connector having the form shown in FIGS. 1 to 12, it is only necessary for the large-diameter portion 13 of the press-fit hole 7 of the connector housing 11 to have such a circular cross section as to ensure such a press-fit interference. That is, a press-fit hole which does not have the groove portions 17 is employed.

However, in the metal terminal 61 shown in FIGS. 15 and 16, the press-fit portion 25 has, on its outer circumferential surface, three projections 32 which bite into the wall surface of the press-fit hole 7. Such projections are provided preferably in such a manner as to be arranged at equal angular intervals in a circumferential direction in a press-fit condition. In the case where the projections 32 are provided, the outside diameter of the press-fit portion 25 may be determined while an increase in press-fit resistance or press-fit interference associated with the bite of the projections 32 is taken into account. That is, when the press-fit portion 25 is press-fit into the press-fit hole 7, the press-fit portion 25 is elastically deformed in a diameter-reduced manner to a greater extent corresponding to the projections 32. In the case where, as shown in FIGS. 15 and 16, the press-fit portion 25 has, on its outer circumferential surface, the projections 32 which bite into the wall surface of the press-fit hole 7, the projections 32 ensure a press-fit condition. Furthermore, as mentioned in the description of the above exemplary embodiment, in the course of the press-fit portion 25 being press-fit into the press-fit hole 7, the projections 32 undergo press-fitting while biting into the wall surface of the press-fit hole in such a manner as to expand the wall surface. Additionally, after press-fitting, the bite of the projections 32 yields a rotation preventing effect and a detachment prevention effect. The metal terminal 61 shown in FIGS. 15 and 16 differs from the metal terminal 21 used in the connector having the form shown in FIGS. 1 to 12 only in the press-fit portion 25 and the projections 32. Thus, like structural features are denoted by like reference numerals. Each of the projections 32 of the metal terminal 61 has a profile similar to that of the projection 32 provided at the bottom 33 of the press-fit portion 25 of the metal terminal 21.

DESCRIPTION OF REFERENCE NUMERALS

1: housing body
7: press-fit hole
11: connector housing
17: groove portion (rotation preventing portion)
21, 61: metal terminal
23: counterpart connection portion
25: press-fit portion
27: shank of U-shaped press-fit portion
29: lead-wire connection portion
31, 32: projection
41: lead wire
51: sealing elastic member
101: connector
201: circuit-board-mounting case
250: circuit board
G2: imaginary axis extending in longitudinal direction of metal terminal

VARIATIONS AND MODIFICATIONS OF EXEMPLARY EMBODIMENTS

Although the invention has been described above in relation to exemplary embodiments thereof, it will be understood by those skilled in the art that variations and modifications can be effected in these exemplary embodiments without departing from the scope and spirit of the invention. No particular limitation is imposed on the press-fit portion of the metal terminal so long as the press-fit portion is formed by bending the sheet metal which forms the metal terminal, in such a manner as to be curved around an imaginary axis extending in the longitudinal direction of the metal terminal. Thus, the press-fit portion may assume the form of a polygonal tube in addition to a form having a U-shaped cross section and the form of a cylinder. Also, the position and the number of projections provided on the press-fit portion and adapted to bite into the wall surface of the press-fit hole may be determined as appropriate according to the shape or structure of the press-fit portion and the press-fit hole or according to a press-fit interference and in view of rotation preventing and anti-detachment properties. The lead-wire connection portion and the counterpart connection portion of the metal terminal may assume, respectively, appropriate shapes.

What is claimed is:

1. A connector comprising:

a metal terminal defining a longitudinal direction, formed of sheet metal and connected to an end portion of a lead wire, the metal terminal being press-fit, in a press-fit direction, into a press-fit hole formed in a connector housing made of resin by pushing a counterpart connection portion of the metal terminal located on a rear end side of the metal terminal with respect to the press-fit direction, the metal terminal comprising a lead-wire connection portion located on a front end side of the metal terminal with respect to the press-fit direction; and a sealing elastic member, which is externally attached to an end portion of the lead wire located toward the metal terminal or to a portion of the lead wire located toward the end portion prior to press-fitting of the metal terminal into the press-fit hole, and which establishes a seal between an outer circumferential surface of the lead wire and a wall surface of the press-fit hole following the press-fitting of the metal terminal into the press-fit hole;

the metal terminal further including a press-fit portion between the lead-wire connection portion and the counterpart connection portion, the press-fit portion comprising a curved portion of the sheet metal of the metal terminal, which curves around an imaginary axis extending in the longitudinal direction of the metal terminal; and the metal terminal being press-fit into the press-fit hole by virtue of the press-fit portion being press-fit into the press-fit hole.

2. A connector according to claim 1, wherein the press-fit portion of the metal terminal comprises a U-shaped portion as viewed in cross section taken perpendicular to the imaginary axis;

wherein the wall surface of the press-fit hole includes rotation preventing portions with which shanks of the U-shaped portion are respectively engaged so as to prevent the press-fit portion press-fit into the press-fit hole from turning about the imaginary axis; and wherein, in a state where the press-fit portion is press-fit into the press-fit hole, the shanks of the U-shaped portion are engaged with the respective rotation preventing portions.

3. A connector according to claim 2, wherein the press-fit portion includes a projection which, in a state where the press-fit portion is press-fit into the press-fit hole, bites into the wall surface of the press-fit hole.

4. A connector according to claim 2, wherein the press-fit portion includes at least one projection provided at each end of the shanks of the U-shaped portion and on the exterior of a bottom part of the U-shaped portion, which, in use, each bite into the wall surface of the press-fit hole.

5. A connector according to claim 1, wherein the press-fit portion includes a projection which, in a state where the press-fit portion is press-fit into the press-fit hole, bites into the wall surface of the press-fit hole.

6. An assembly comprising a circuit-board-mounting case including the connector according to claim 1 wherein the connector is attached to the circuit-board-mounting case with the lead wire extending to the exterior of the connector, and in which the counterpart connection portion of the metal terminal is connected to an electrode terminal of a circuit board mounted within the circuit-board-mounting case.

7. A connector assembly comprising:

a metal terminal defining a longitudinal direction and formed of sheet metal, the metal terminal comprising:

a lead-wire connection portion located on a front end side of the metal terminal with respect to a press-fit direction;

a counterpart connection portion located on a rear end side of the metal terminal with respect to the press-fit direction; and a press-fit portion located between the lead-wire connection portion and the counterpart connection portion, the press-fit portion comprising a curved portion of the sheet metal, which curves around an imaginary axis extending in the longitudinal direction;

a lead wire comprising an end portion connected to the lead-wire connection portion of the metal terminal and comprising an outer circumferential surface;

a connector housing comprising a press-fit hole having a wall surface, the press-fit portion of the metal terminal being press-fit into the press-fit hole; and a sealing member providing a seal between the outer circumferential surface of the lead wire and the wall surface of the press-fit hole.

* * * * *